US005203881A

United States Patent [19]

Wiand

[11] Patent Number: 5,203,881

[45] Date of Patent: Apr. 20, 1993

[54] ABRASIVE SHEET AND METHOD

[76] Inventor: Ronald C. Wiand, 1494 Heatherwood, Troy, Mich. 48098

[21] Appl. No.: 751,339

[22] Filed: Aug. 29, 1991

Related U.S. Application Data

[63] Continuation-in-part of Ser. No. 474,373, Feb. 2, 1990, Pat. No. 5,131,924.

[51] Int. Cl.[5] ..... B24D 3/00

[52] U.S. Cl. ..... 51/293; 51/295; 51/298; 51/309

[58] Field of Search ..... 51/293, 295, 298, 309

[56] References Cited

U.S. PATENT DOCUMENTS

| | | | |
|---|---|---|---|
| 778,811 | 7/1957 | Cowan et al. | 180/54.1 |
| 2,201,196 | 5/1940 | Williamson | 51/278 |
| 2,740,239 | 4/1956 | Ball et al. | 51/404 |
| 2,778,169 | 1/1957 | Ball | 51/188 |
| 2,876,086 | 3/1959 | Raymond | 51/298 |
| 3,860,400 | 1/1975 | Prowse et al. | 51/295 |
| 3,869,263 | 3/1975 | Greenspan | 51/209 R |
| 3,918,217 | 11/1975 | Oliver | 51/295 |
| 4,010,583 | 3/1977 | Highberg | 51/284 |
| 4,047,902 | 9/1977 | Wiand | 51/295 |
| 4,114,322 | 9/1978 | Greenspan | 51/206 R |
| 4,282,011 | 8/1981 | Terpay | 51/293 |
| 4,285,171 | 8/1981 | Block et al. | 51/293 |
| 4,668,248 | 5/1987 | Dettelbach et al. | 51/293 |
| 4,836,832 | 6/1989 | Tumey et al. | 51/295 |
| 4,916,869 | 4/1990 | Oliver | 51/293 |
| 4,925,457 | 5/1990 | deKok et al. | 51/295 |
| 4,964,884 | 10/1990 | Jürissen et al. | 51/293 |
| 4,974,373 | 12/1990 | Kawashima et al. | 51/295 |

*Primary Examiner*—Mark L. Bell
*Assistant Examiner*—Willie J. Thompson
*Attorney, Agent, or Firm*—Harness, Dickey & Pierce

[57] ABSTRACT

A perforated metal sheet including diamond particles brazedly attached.

9 Claims, 4 Drawing Sheets

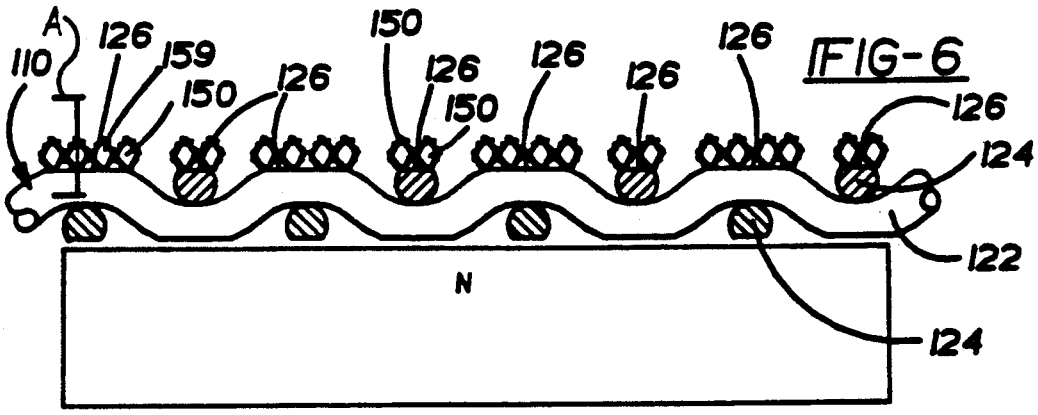
FIG-6
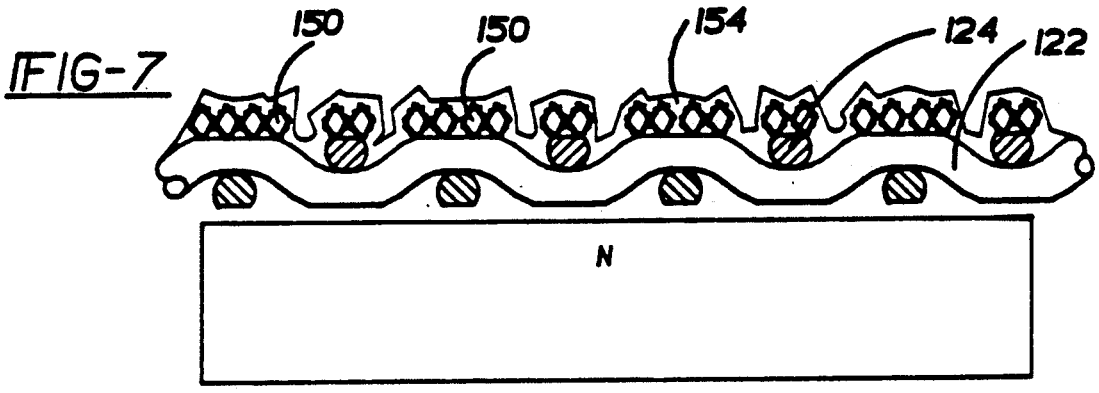
FIG-7
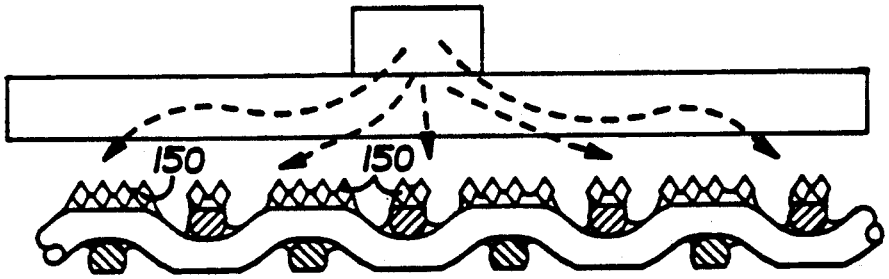
FIG-8
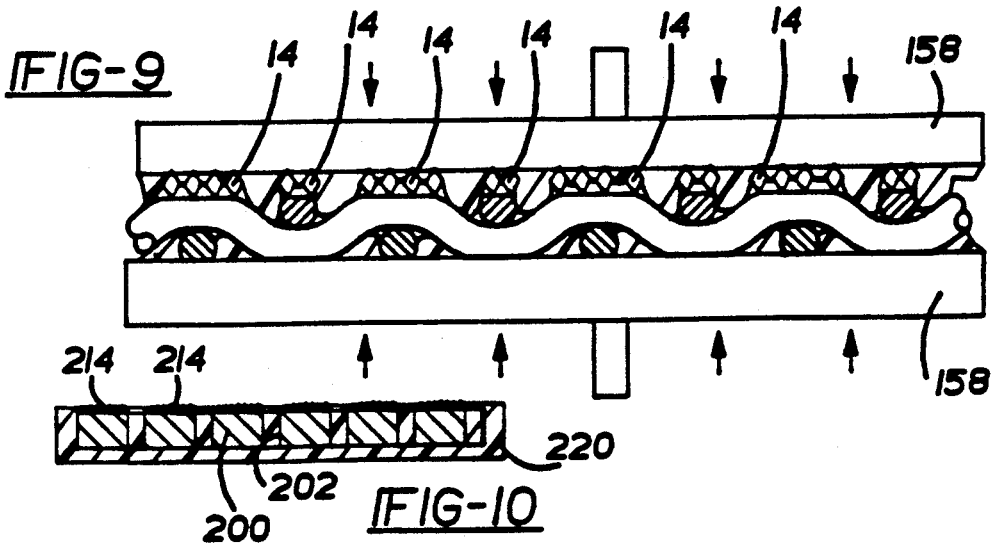
FIG-9
FIG-10

ABRASIVE SHEET AND METHOD

RELATED APPLICATIONS

This application is a continuation-in-part of U.S. Ser. No. 474,373, filed Feb. 2, 1990, now U.S. Pat. No. 5,131,924, entitled "Abrasive Sheet and Method".

BACKGROUND OF THE INVENTION

The present invention relates to abrasive sheets and methods of producing abrasive sheets. More particularly, the present invention relates to flexible abrasive sheets for withstanding heavy usage in the abrasion of materials. The present invention also relates to an abrasive sheet which provides for improved swarf clearance and reduction in quantities of diamond grit material used.

It has been a goal in the art to provide flexible abrasive sheets which have diamond-like hardness abrasive grit particles attached to discrete portions of the sheets. While many such constructions have been attempted in the past the resulting abrasive sheet materials were generally lacking in their durability in that particles were easily disattached during use, thereby rendering the abrasive sheet unsuitable for some uses. It has also been a goal to provide abrasive sheets which include discrete patterns or areas where abrasive grits are attached while leaving other areas open and without abrasive grits. It has also been a goal in the art to provide structures wherein portions of the abrasive grit particles remain exposed after formulation of the abrasive sheet to provide a biting or cutting type structure.

A flexible abrasive sheet is shown in U.S. Pat. No. 3,860,400 to Prowse et al. In this patent an abrasive sheet is disclosed wherein a perforated sheet material or mesh material is embedded in a non-conductive backing substrate such that portions of the sheet or mesh extend from the substrate. Thereafter the grit particles are electroplated onto the extending areas to provide the final abrasive grit structure. While this abrasive sheet provides an advantageous construction because the abrasive grit particles are attached by electroplating, the durability of the article is still limited as to an electroplated structure. Patents such as U.S. Pat. No. 4,047,902 to Wiand and U.S. Pat. No. 2,876,086 to Raymond disclose the use of masks or templates or the like to provide for discrete areas of diamond to attach to a substrate. While such structures have reduced diamond grit consumption, such procedures are not readily adaptable to braze techniques. Also, resulting structures have no provision for swarf removal or introduction of coolants or lubricants through the abrasive sheet as may be required in some applications.

It is therefore an object of the present invention to provide an abrasive sheet which is more durable than the prior constructions.

It is a further object of the present invention to provide a cutting type abrasive sheet.

It is still further an object of the present invention to provide improved methods of formulating abrasive sheets to produce an abrasive sheet in accordance with the above objects.

It is a further object of the present invention to provide a brazed abrasive sheet which allows for swarf removal and increase of coolants and lubricants and further is a brazed sheet with discrete areas of diamond for saving consumption of diamond in production of such a sheet.

SUMMARY OF THE INVENTION

In accordance with these goals and objectives, the present invention provides an improved structure whereby an abrasive sheet can be provided with superior durability characteristics in that the abrasive grit particles are brazedly attached to a mesh or sheet substrate with spaced apertures therethrough and having at least a layer of metal material which will allow a braze material to stick to the metal material. This gives the abrasive sheet of the present invention the advantage of providing a coated or backed abrasive sheet with the abrasive grit particles securely held in position on the sheet substrate with a braze material to provide secure attachment and durability to the sheet. Additionally, in the present invention there is provided a method of making a "cutting type" abrasive sheet whereby exposed portions of the abrasive grit particles are facilitated to provide extra cutting area while still giving secure attachment to the particles.

Thus, according to the present invention, there is provided an abrasive sheet which includes a backing substrate with a sheet element having at least a layer of a metal material thereon which is embedded in the backing substrate at the surface thereof. The sheet element includes a plurality of apertures therein and has an abrasive grit particulate material which is brazed onto the metal layer of the sheet.

Also, in accordance with the present invention, there is provided a method of manufacture of an abrasive sheet which includes the steps of first providing a substrate having a plurality of apertures therein and having a metal surface which is compatible for brazing onto the surface and coating the metal surface with a mixture of an infiltrant and a tacky temporary binder. Next, a layer of grit particles is sprinkled onto the tacky coating and is thereafter heated to attach the grit particles to the substrate. The brazed substrate may be utilized in this manner or be is then embedded in a backing material or attached to a backing material. This produces a product which has a perforated sheet portion with grit particles brazedly attached thereto in discrete areas at the surface of the backing substrate. The apertures in the substrate reduce the amount of diamond grit material used since no brazing of the diamond occurs at the apertures. Thus, discrete areas of diamond are provided on a brazed abrasive sheet without the use of a mark. The apertures also provide for swarf removal and allow for cutting lubricants or other materials to pass through the abrasive sheets.

In an alternate embodiment the perforated substrate may be perforated such that co-planar protrusions extend from the side opposite of the brazed side whereby these protrusions act to provide for attachment to a substrate while allowing for swarf removal clearance.

Additional benefits and advantages of the present invention will become apparent from the subsequent description of the preferred embodiments and the appended claims taken in conjunction with the accompanying drawings.

BRIEF DESCRIPTION OF THE DRAWINGS

FIG. 6 is a cross-sectional view showing the alignment of magnetically interactive particles on the flattened surfaces of the mesh material;

FIG. 7 is a cross-sectional view showing a temporary binder coating for temporarily adhering the magnetically aligned particles in the aligned position on the mesh substrate;

FIG. 8 is a cross-sectional view showing schematically the application of heat to the combination of FIG. 7 for brazing of the particles onto the substrate;

FIG. 9 is a cross-sectional view showing schematically the application of pressure for embedding the combination of FIG. 8 in a backing sheet such that portions of the abrasive grit particles are exposed in the final structure;

FIG. 10 is a cross-sectional view of a perforated sheet abrasive structure made in accordance with the teachings of the present invention;

DESCRIPTION OF THE PREFERRED EMBODIMENTS

Figure 1:
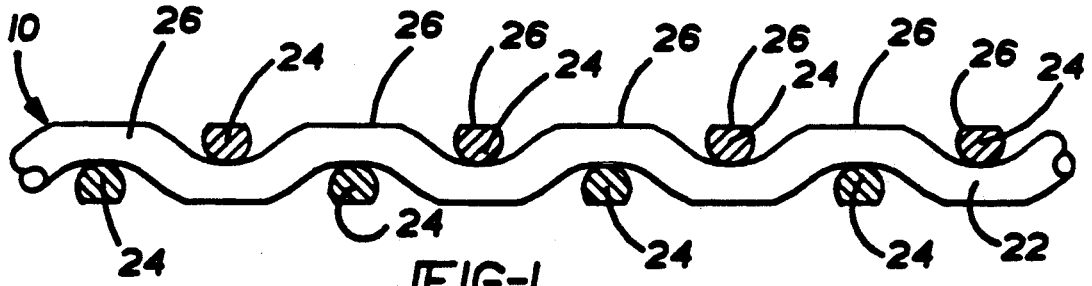
FIG. 1 is a cross-sectional view of a mesh substrate prepared in accordance with the teachings of the present invention.
Figure 2:
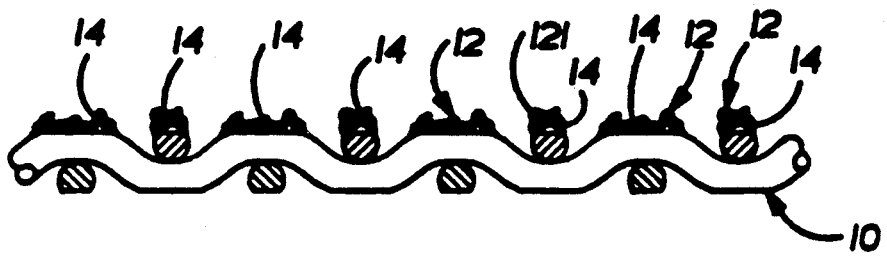
FIG. 2 is a cross-sectional view of the mesh substrate of FIG. 1 having a coating of brazing material, grit particles and a temporary binder for adhering the grit particles to the flat surface areas of the prepared mesh material.
Figure 3:
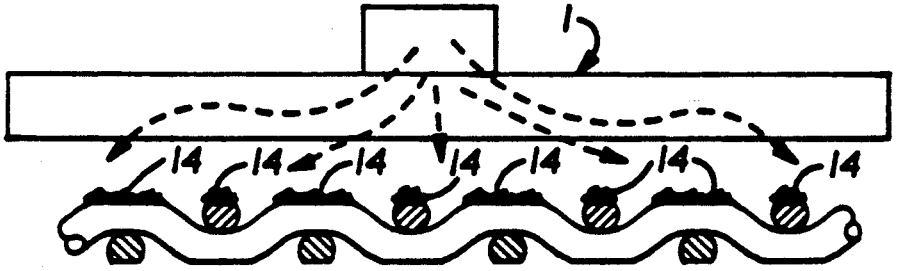
FIG. 3 is a cross-sectional view showing schematically the application of heat to the combination of FIG. 2 for brazing of the abrasive grit particles to the flat surfaces of the mesh.
Figure 4:
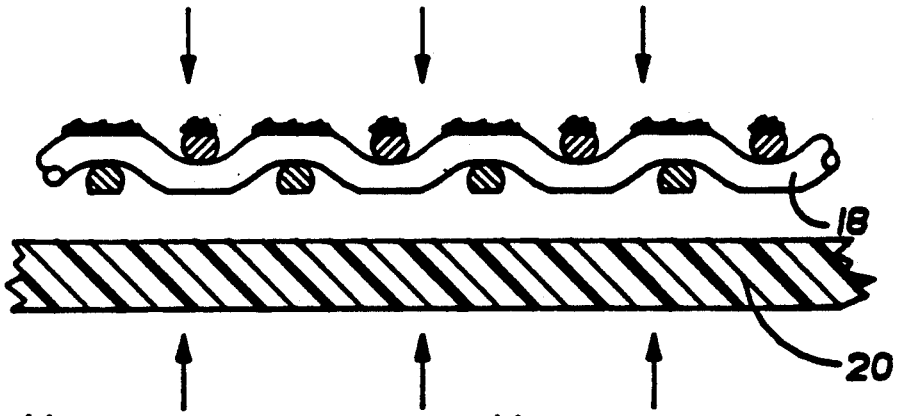
FIG. 4 is a cross-sectional view showing the placement of a backing substrate sheet material for preparation for embedding the brazed mesh element of FIG. 3 in the substrate material.

Referring now to the drawings, a method of manufacturing a novel abrasive sheet structure is provided having the steps of first providing a substrate 10 having a plurality of apertures therein. The substrate 10 has at least a metal surface, such as a metal layer which is compatible with a brazing compound, for brazedly attaching a grit material to the surface of substrate 10. In a preferred embodiment the substrate is a metal substrate. The metal substrate 10 is then coated with a mixture of a braze and a tacky temporary binder 12. A layer of grit particles is then sprinkled onto the coating or in the alternative is employed in the coating of the above step for temporarily adhering the particles to the braze material. Thereafter, the product having the braze material and grit particles temporarily adhered thereto is heated by placement in an oven 16 and heating to cause the temporary binder to be driven off, and the braze to infiltrate the abrasive grit for adhering the abrasive grit onto the metal substrate 10 as shown in FIG. 3. Thereafter, the product is then embedded in a backing substrate by applying the backing substrate as shown in FIG. 4. The final product, shown in FIG. 5, includes a backing substrate material 20 in which a metal substrate 10 is embedded in the backing substrate 20 at the surface thereof.

A novel and improved screen type of material is provided in the present invention whereby a series of discrete flat surfaces 26 are facilitated for purposes of attaching the abrasive grit particles. These discrete "cutting" areas are preferable in many abrasive grit structures.

A mesh material having flattened portions at the intersections between warps 22 and woofs 24 of a woven screen-like mesh material are provided by placing the screen between a set of plates in a press or the like, and applying a pressure sufficient to flatten these areas to the extent desired. Such a configuration provides advantageous flat portions 26 on which an abrasive grit material may be attached. The size of the flattened portions may be adjusted according to the amount of pressure used in the step of flattening these areas.

This provides a final construction whereby a large surface area of abrasive grit containing areas is provided on the completed abrasive sheet and utilizes a flattened area to provide the abrasion. Thus, such a structure provides for an advantageous attachment of these particles to provide a substantially co-planar coating of abrasive grit particles.

In an alternate embodiment the substrate could be of a suitable material which has a metal layer deposited thereon which would retain its structural integrity at a brazing temperature. Such suitable materials include ceramics, carbon and carbon fiber materials. In a preferred embodiment, a woven ceramic screen, such as made out of an alumina ceramic fiber material, could be utilized as a suitable mesh material. This is accomplished by the addition of a layer of titanium, chromium, gold, silver, iron, copper, aluminum, brass, metal or metal-like materials to which the braze will adhere on the surface of the ceramic mesh. Such a layer can advantageously be provided by the use of vapor deposition or electrodeless deposition technologies which are commonly available today. In the case of a carbon substrate electrodeposition of the metal layer could be accomplished. Such a layer would provide a surface on which abrasive grit particles could be brazed to a ceramic substrate. This structure allows for a brazed grit holding power and tenacity, while retaining the advantageous characteristics of a ceramic material, such as heat dissipation and insulating characteristics.

Similarly, a ceramic sheet substrate could be utilized in the process and products of the present invention. Accordingly, a ceramic sheet substrate of an alumina material or the like could be provided of a suitable shape and with a plurality of apertures. The ceramic sheet useful in the present invention has a surface layer of a metal material, such as titanium or chromium, which is vapor deposited thereon and is compatible with the braze material to be used. Such a layer provides a suitable attachment point for brazing of abrasive grit particles on the substrate.

The infiltrant and binder materials used herein are similar to those set forth in my copending application Ser. No. 310,783 entitled "A Multi-layer Abrading Tool and Process" filed on Feb. 14, 1988 which is hereby incorporated herein by reference.

Suitable binders useful herein are temporary in that they temporarily adhere the infiltrant and the abrasive grit particles to the flat portions 26 prior to the heating step for infiltrating the abrasive grits and attaching them to the flat portions of the metal sheet element 10. Suitable binders may include acrylic resins, methylacrylate resins, lacquers, paints, urethanes and the like. Other suitable binders could include water/flour or water/-sawdust binders which may produce desirable effects in the final abrasive matrix coating. A particularly preferred temporary binder includes a Wall Colmonoy "type S" viscous water soluble urethane cement. Other suitable binders may be used, however, the binder must be one such that it can be readily driven off through heat or other means prior to heating the substrate for allowing the braze to attach the abrasive grit particles to the underlying perforated sheet metal element 10.

The braze used may be of any of the long wearing brazing materials known in the art, such as nickel chromium brazing powders and the like. Particularly, preferred infiltrant materials include the Wall Colmonoy L.M. 10 Nicrobraz® material containing 7.0% chromium, 3.1% boron, 4.5% silicon, 3.0% iron and the balance nickel; however, other brazing type infiltrants may be used as is known to those skilled in the art. The braze step has the further advantage of brazing the mesh structure together at the intersections between the woofs and the warps to provide a much stronger and more durable mesh structure than the prior art screen type abrasive sheet structures.

Figure 5:
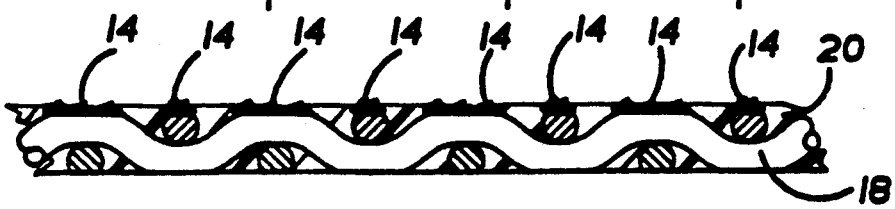
FIG. 5 is a cross-sectional view showing the completed abrasive sheet made in accordance with the teachings of the present invention.
Figure 11:
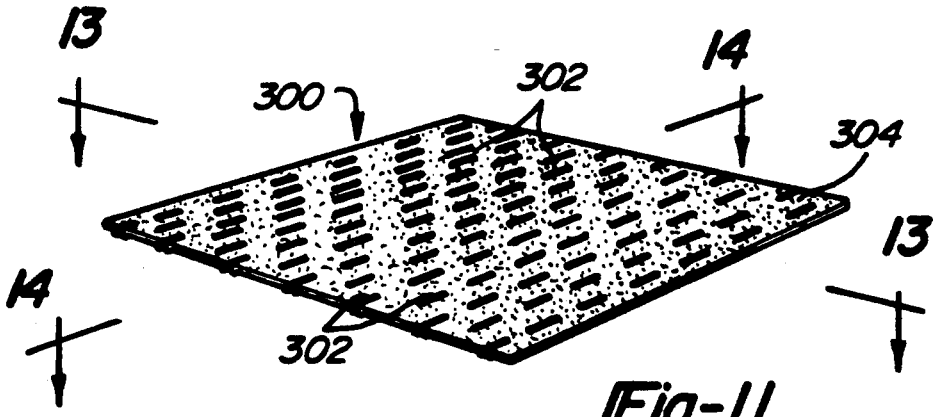
FIG. 11 is a front perspective view of an abrasive sheet with improved swarf clearance.
Figure 12:
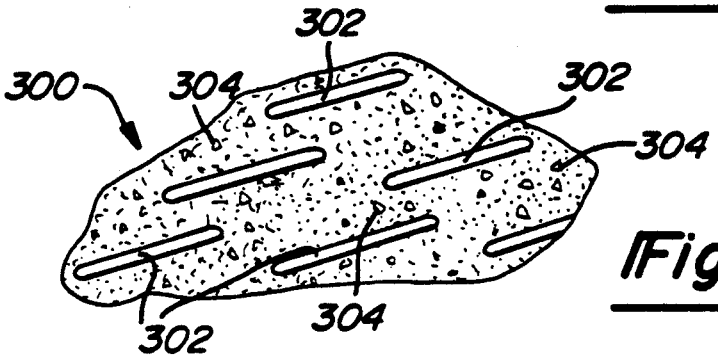
FIG. 12 is a detailed perspective view of the abrasive sheet of FIG. 11.
Figure 13:
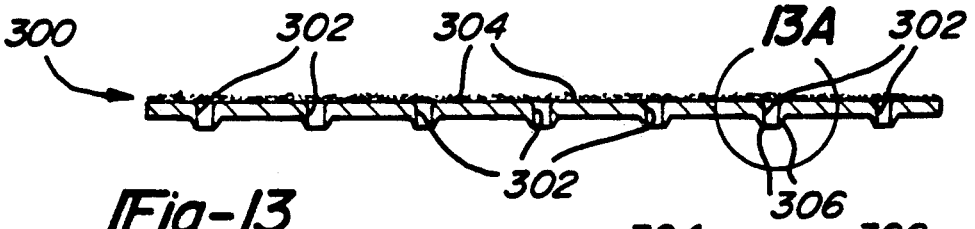
FIG. 13 is a sectional view of the abrasive sheet of FIG. 11 taken along line 13—13.
Figure 13A:
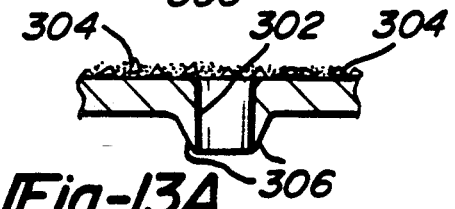
FIG. 13*a* is a detailed view taken from FIG. 13 showing the protrusions in detail.
Figure 14:
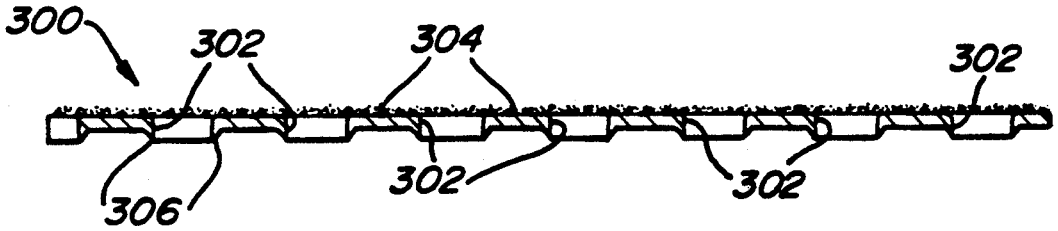
FIG. 14 is a view showing an abrasive sheet such as FIG. 11 affixed to a backing substrate.

The backing substrate may be provided by any of a number of means such as spray coating, extrusion, injection molding and the like of suitable materials. Suitable backing materials include polymeric type materials. In a preferred embodiment the backing material is a flexible type material such as an elastomer. Particularly suitable polymeric materials include synthetic plastics, rubbers and latexes. Preferred materials include polypropylenes, acrylic butydienes (ABS), styrene acrylic nitrides, nylons, methylmethacrylate resins, polyethylenes, epoxies, fiberglass or other resin compositions. It is preferable that the material selected for use in the methods herein is at least pressure deformable and preferably a thermoformable material such that it can be formed with heat or with pressure alone into the apertures in the sheet substrate used. The backing substrate may be applied to the side 18 opposite to that on which the abrasive grit surface has been added to the perforated sheet. In a preferred embodiment of the invention this backing substrate may be applied by placing a pressure and heat deformable backing substrate sheet over the brazed perforated metal sheet on the side containing the abrasive grit particles. This combination is placed in a press having facing planar surfaces. Heat and pressure is applied for deforming the backing material and forcing it into the perforations thereby embedding the perforated sheet into the polymer material (as shown in FIG. 5) such that the perforated sheet substrate is at the surface of the backing sheet.

Abrasive grit particles suitable for use in the present invention include abrasive grit particles commonly used in abrasive grit structures, which are brazeable in a suitable braze matrix. Preferably, the diamond-like hardness abrasive grits such as tungsten carbide, cubic boron nitrite, and diamond grit particles are utilized in the present invention.

Referring now to FIGS. 6 through 9 there is provided a method for producing a cutting type abrasive grit structure whereby portions of the abrasive grit particles extend from the structure to provide a cutting type structure in an abrasive sheet.

In this alternate embodiment magnetically interactive grit particles 150 are placed on the flattened surfaces of the prepared screen substrate 110. A magnet 152 is provided and is placed underneath the substrate 110 with a single pole of the magnet the north pole is shown, facing the substrate structure. This aligns the magnetic interactive particles such that an axis (A) passing through their greatest length is substantially perpendicular to the plane of the substrate material, i.e., surfaces 126. Thereafter, a temporary binder coating 154 is applied to temporarily hold the particles in this aligned position. Thereafter, a brazing material may be applied to the coated particles and the product would be heated to braze the grit particles onto the substrate. As shown in FIG. 9, the product is embedded in a backing sheet with cutting portions of the grit particles exposed by placing the backing sheet underneath the brazed product in a heated platen press.

A special press arrangement is used in this embodiment wherein a first upper pressure plate 158 and a second lower pressure plate 158 are provided such as by using a heated platen press. Upper pressure plate 158 is made or lined with a material which is conformable with respect to the particular grit particles being used such that when pressure is applied the grit particles partially embed themselves into the upper pressure plate 158. Pressure plate 156 is substantially nonconformable such that the grit particles only extend into plate 158 during the final embedding step. Suitable magnetically interactive particles include ferric oxide, diamond coated with ferric oxide and tungsten carbide. Preferably, particles such as diamonds may be made magnetically interactive by coating the particles with an iron powder.

Suitable materials from which the conformable plate 158 may be constructed include materials such as graphite, polypropylene, polyethylene, cardboard, aluminum foil coated cardboard or a REEMAY® cloth type material or the like. In a preferred embodiment a plate suitable for use in the present invention utilizes a sheet of a polyethylene material attached to the upper plate 158 of a heated platen press.

In a preferred embodiment a release agent is utilized between the conformable upper plate 158 and the brazed diamond abrasive sheet. Such a release agent will provide for ease of separation between the conformable plate and the coated abrasive sheet. Suitable release agents include silicon coatings and the like. A preferred release agent is a silicon coated release sheet such as that used as a backing for adhesive stickers and the like. Such a release sheet can be interposed with the silicon side facing the diamond abrasive. It has been found that utilizing such a release sheet allows the extruded polypropylene material to flow between the diamond particles and under the release sheet to provide a substantially even surface therebetween. This is advantageous in an abrasive sheet construction since concavities in such a structure will collect undesirable debris which could damage a work surface when using the abrasive sheet.

FIG. 10 shows an alternate embodiment of the structure herein where a perforated thin sheet 200 is provided having apertures 202 therein. In this embodiment the sheet material 200 is embedded in the backing sheet material similarly as that shown above with the backing material flowing into the apertures in the sheet thereby providing a further abrasive sheet construction. This embodiment provides the advantage of utilizing a brazed type bonded abrasive grit structure for durability while providing a flexible durable backing member.

A "cutting" type abrasive sheet may also be formulated and is beneficial without the step of magnetically aligning particles. Thus, in this alternate embodiment a suitable grit material is brazed onto a perforated substrate and the brazed grit side is placed in a heated platen press with the release agent and conformable sheet adjacent the grit side. The sheet is thereafter embedded into a backing substrate as disclosed above, to form a "cutting" type abrasive sheet.

Referring now to FIGS. 11 through 15, there is shown an alternate embodiment of an abrasive sheet 300. Abrasive sheet 300 includes apertures such as perforations 302 therethrough. Perforations 302 are rectangular in the embodiment shown, however, the perforations could also be round, triangular or other shapes. The perforations provide two benefits to the abrasive sheet. First, the perforations provide an avenue by which swarf can be removed from the work surface under abrading conditions. Second, the perforations reduce the abrading surface area onto which diamond particles are brazedly attached. Thus, there is a net reduction in the amount of diamond used in production of such abrasive sheets. In the present invention from about 10% to about 90% of the surface area encompassed by the sheet is perforated leaving from about 10% to about 90% of a metal surface onto which the diamond is brazed. In a preferred embodiment, from about 15% to about 20% of the surface area encompassed by the abrasive sheet remains. This allows for brazed attachment of diamond grit material 304 on this remaining metal surface.

In this embodiment the perforations are accomplished such that protrusions 306 extend from the surface opposite the brazed diamond surface 308. The protrusions 306 allow for attachment to substrates such as those shown in FIGS. 15 and 17. These protrusions are coplanar such that any deformities in the sheet caused at the time of brazing will be eliminated during the attachment to a planar substrate since all of the protrusions are designed to connect either adhesively or otherwise to the substrate. The protrusions are made during the punching of the perforations in the metal, in that as the series of punches travel through the virgin metal sheet the metal at each perforation is deflected downward and out thus, forming protrusions 306.

Figure 15:
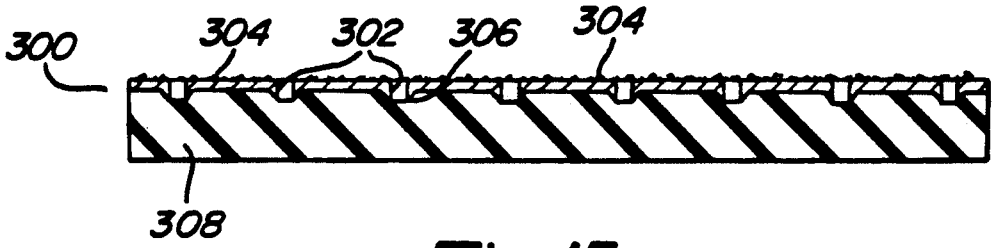
FIG. 15 is a view showing an abrasive sheet of the present invention affixed to a backing sheet.

Referring now to FIG. 15, the perforated sheet 300 may be adhesively attached to dense foam rubber block or the like 308. As shown in FIG. 15, the protrusions 306 are sunk into the foam rubber providing further clearance at the apertures 302 for collection of swarf. Preferably, the foam rubber backing is porous such that lubricants and/or coolants can be passed through the backing. It is also within the scope of the present invention that the protrusions can be attached at the surface of the foam rubber block or the like to provide even greater space under the abrasive sheet for collection and removal of swarf.

Figure 16:
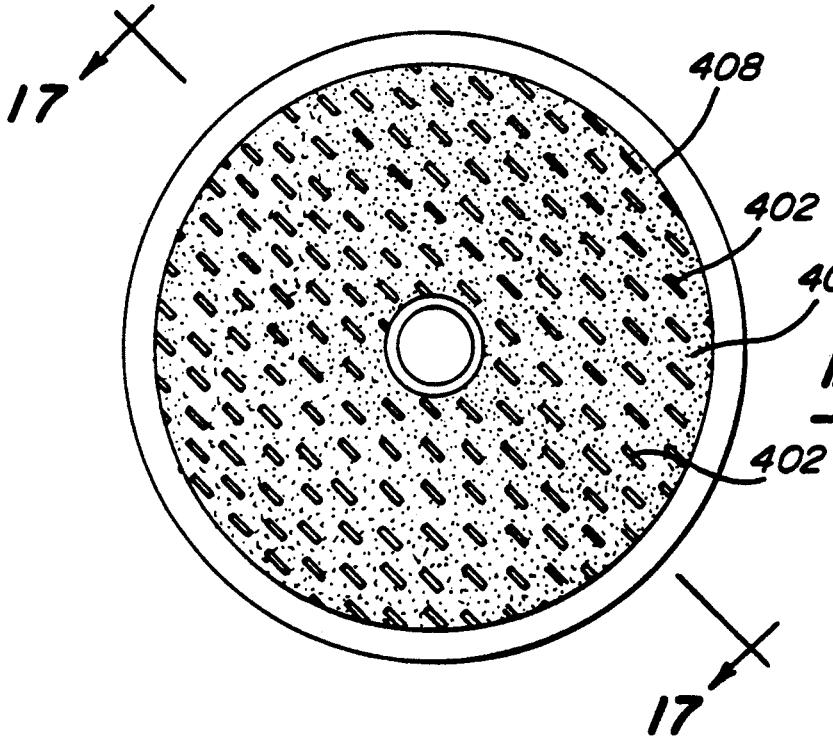
FIG. 16 is a front view of an alternate embodiment of an abrasive sheet attached to a polypropylene backing material.
Figure 17:
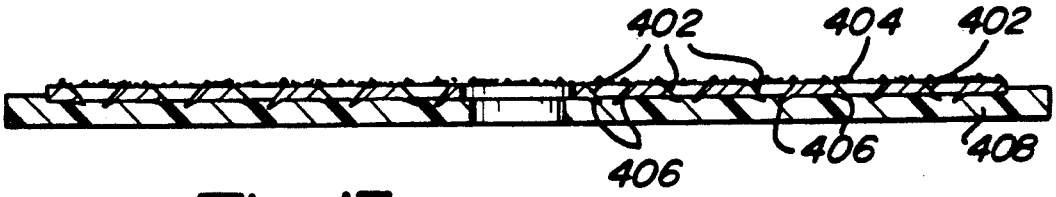
FIG. 17 is a sectional view taken along line 17—17 of FIG. 16.

Referring now to FIGS. 16 and 17, there is shown an alternate embodiment of an abrasive sheet 400 shaped in a round configuration and attached to a round polypropylene substrate 408 by embedment of the protrusions 406 in the substrate. The abrasive sheet is like that shown in FIGS. 11–15 having rectangular perforations 402 and abrasive grit 404 brazedly attached. This embodiment exemplifies that the abrasive sheet 400 may be attached to other substrates. In this embodiment the sheet is embedded such that only the protrusions 406 embed in the polypropylene substrate thus, leaving the perforations 402 for swarf collection. As will be noted, the protrusions are embedded in the plastic sheet under pressure and some heat such that substantially only the protrusions are embedded, thereby leaving voids, the thickness of the abrasive sheet at each of the perforations. This partially deflects the protrusions 406 when embedding occurs such that they are angularly disposed with respect to the plane of the backing substrate 408.

When the perforated substrate is used as a separate sheet rather than embedded in the plastic the perforations allow for swarf removal through the perforations and also allow for coolants or lubricants to be introduced through the pad structure during sanding or abrading operations. When the protrusions are spaced from a substrate additional swarf clearance is provided between the abrasive sheet and the substrate material. This provides for advantageous removal of material even when a thick backing material is utilized.

Further understanding of the present invention will be had by reference to the following examples which are presented herein for purposes of illustration but not limitation.

EXAMPLE I

A flexible abrasive sheet was prepared as follows.

A 12 metal mesh screen having 0.028 diameter wire was provided. The mesh screen was placed in an oven at a temperature of 800° F. for about two minutes to decompose protective any coating or corrosion resistant treatment on the wire.

A 12"×12" square of the above screen was pressed between flat parallel plates at 50 tons pressure to produce flats, all in the same plane, on the wire mesh at the intersection of the woofs and the warps of the mesh.

A roller applicator was used to coat the flats of the wire mesh with a braze paste of 80% Wall Colmonoy L.M. No. 10 Microbrazing powder −325 mesh particle size mixed with 3% iron powder (4–6 micron), 10% Molybdenum powder (10 micron) and "type S" cement.

A coating of 40/50 diamond grit was sprinkled onto the paste covered flat surfaces.

The substrate was then placed in vacuum furnace and held at a vacuum of $10^{-5}$ torr. The oven was heated first at a temperature of about 80° F. for 15 minutes and thereafter the temperature was raised to a temperature of about 189° F. for about 3.25 minutes.

Thereafter the brazed sheet was placed diamond side up onto a 12"×12" sheet of polypropylene in a heated platen press and was thereafter pressed under 10 tons of pressure at 350° F. for 30 seconds.

The screen was found to be embedded in the plastic sheet with the flat areas containing the brazed grit coating at the surface of the plastic sheet. The resulting sheet was found to produce a flexible, strong, wear resistant, non loading and fast cutting abrading sheet.

EXAMPLE II

A "cutting" type abrasive sheet is prepared as follows.

A 12 mesh screen substrate having flattened surfaces at the intersections between the woofs and warps is prepared as set forth in Example I.

Diamond particles coated with iron oxide of a 40/50 size are sprinkled onto the flattened areas.

A pole of a magnet is placed adjacent the underside of the structure to align the particles such that an axis passed through their longest dimension is substantially perpendicular to the plane of the flattened surfaces. A coating of thinned "S" type cement is sprayed on the aligned particles to temporarily adhere the particles in the aligned position on the flattened areas. The cement is allowed to cure and the magnet is removed. A coating of 80% Wall Colmonoy L.M. No. 10 brazing powder −325 mesh particle mixed with 3% iron powder (4–6 micron) and 10% Molybdenum powder (10 micron) is sprinkled on the surface and thereafter the product is heated as set forth in Example I.

A product is produced having the particles brazed onto the substrate in the aligned configuration. The brazed structure is placed on top of a 12"×12" polypropylene sheet. On top of the diamond side of the brazed mesh is placed a silicon coated release sheet, such as that commonly used for backing of adhesive stickers, with the release side facing the diamond particles. On top of the release sheet is placed a plate made out of a polyethylene material which is deformable with respect to the diamond grit particles. Thereafter the assembly is subjected to 10 tons of pressure at 350° F. The brazed substrate is found to be embedded in the plastic sheet with edges of the grit particles exposed to provide a cutting type abrasive sheet.

EXAMPLE III

A "cutting" type abrasive sheet was prepared as follows.

A 0.0315" thick steel sheet was perforated with 3/32" holes on a 60 degree stagger between 3/10" center 33 holes/in$^2$ providing a perforated steel sheet with 37% surface area and 63% open area. The sheet was cut to a 4¾" disc shape and was thereafter coated with a braze paste which includes: 80% −325 mesh particle size, Wall Colmonoy L.M. No. 10; 3% iron powder in the 4–6 micron range; 10% Molybdenum powder in the 10 micron range and Wall Colmonoy "type S" cement.

80/100 diamond was then sprinkled onto the coated surfaces of the steel sheet. This coated product was then placed in a vacuum furnace at a vacuum of $10^{-5}$ torr. The oven was heated first at a temperature of about 800° F. for 15 minutes and thereafter the temperature was raised to 1740° F. for about 5 minutes for brazing the diamonds onto the substrate.

Thereafter, the brazed sheet was placed (diamond grit face up) on a four thousandths of an inch polypropylene sheet. A silicon release sheet such as that of Example II was placed silicon side down on top of the brazed diamond surface. A polyethylene sheet was placed on top of the release sheet. The brazed sheet so prepared was placed in a heated platen press and pressed under 10 tons of pressure at 350° F. for 30 seconds. During this pressing the diamond particles partially embed in the release sheet and polyethylene sheet and the polypropylene was extruded through the holes in the metal sheet and under the silicon release sheet to coat and embed the metal sheet in the polypropylene.

The product was removed from the platen press and the cutting edges of the diamond particles were exposed. A substantially flat coating of polypropylene was found between the diamond particles. The steel substrate was embedded in the polypropylene sheet.

EXAMPLE IV

An abrasive sheet is prepared as follows.

A mesh of woven alumina fibers with a vapor deposited film of titanium on its surface is cut to a disc shape. The titanium side of the mesh is coated with a braze paste which includes: 80% −325 mesh particle size, Wall Colmonoy L.M. No. 10; 3% iron powder in the 4–6 micron range; 10% Molybdenum powder in the 10 micron range and Wall Colmonoy "type S" cement.

80/100 diamond is then sprinkled onto the coated surfaces of the mesh. This product is then placed in a vacuum furnace at a vacuum of $10^{-5}$ torr, then is heated first to a temperature of about 800° F. for 15 minutes and thereafter the temperature is raised to 1740° F. for 5 minutes for brazing the diamonds onto the titanium layer of mesh substrate.

Thereafter, the brazed mesh is placed diamond side up on to a sheet of polypropylene, which combination is heated at a temperature of 350° F. under 10 tons of pressure in a platen press for 30 seconds.

The mesh is found to be embedded in the polypropylene sheet with abrasive grit at the surface at discretely spaced intervals. A strong, wear resistant non-loading fast cutting abrading sheet is formed.

EXAMPLE V

An abrasive sheet is prepared as follows.

A perforated ceramic sheet of alumina with a vapor deposited film of titanium on its surface is cut to a disc shape. The titanium side of the perforated ceramic sheet is coated with a braze paste which includes: 80% −325 perforated ceramic sheet particles size, Wall Colmonoy L.M. No. 10; 3% iron powder in the 4–6 micron range; 10% Molybdenum powder in the 10 micron range and Wall Colmonoy "type S" cement.

80/100 diamond is then sprinkled onto the coated surfaces of the perforated ceramic sheet. This product is then placed in a vacuum furnace at a vacuum of $10^{-5}$ torr, then is heated first to a temperature of about 800° F. for 15 minutes and thereafter the temperature is raised to 1740° F. for 5 minutes for brazing the diamonds onto the titanium layer of perforated ceramic sheet substrate.

Thereafter, the brazed perforated ceramic sheet is placed diamond side up on to a sheet of polypropylene, which combination is heated at a temperature of 350° F. under 10 tons of pressure in a platen press for a period of 30 seconds.

The perforated ceramic sheet is found to be embedded in the polypropylene sheet with abrasive grit at the surface at discretely spaced intervals. A strong, wear resistant non-loading fast cutting abrading sheet is formed.

While the above description constitutes the preferred embodiments of the present invention, it is to be appreciated that the invention is susceptible to modification, variation and change without departing from the proper scope and fair meaning of the accompanying claims.

What is claimed is:

1. A method of manufacture of an abrasive sheet comprising the steps of:

(a) providing a metal sheet substrate having a plurality of spaced apertures therethrough;

(b) coating said sheet substrate with a mixture of a braze and a temporary binder;

(c) applying a layer of grit particles onto the coating of step (b); and (d) heating the product of step (c) to drive off the binder and attach said grit particles to said metallic layer of said sheet substrate.

2. The method according to claim 1 wherein said sheet substrate is a perforated metal sheet.

3. An abrasive sheet comprising:

a metal sheet element having a plurality of apertures therethrough embedded in said backing substrate at the surface thereof; and an abrasive grit material brazedly attached to the metal surface on the outermost facing surface of said sheet element.

4. The abrasive sheet according to claim 3 wherein said metal sheet element is a perforated metal sheet.

5. The abrasive sheet of claim 4 wherein said perforations comprise from about 10% to about 90% of an area encompassed by said abrasive sheet with from about 10% to about 90% of the remaining surface having brazed grit attached thereto.

6. The abrasive sheet of claim 4 wherein from about 15% to about 20% of an area encompassed by the abrasive sheet includes brazed grit attached thereto with the remainder being encompassed by perforations.

7. An abrasive sheet comprising:

a backing substrate;

a metal sheet element having a plurality of perforations therethrough and including a first side and a second side;

an abrasive grit material brazedly attached to said first side of said metal sheet for forming an abrasive sheet;

a plurality of protrusions extending from said second side, said protrusions being attached to said backing substrate in a co-planar manner thereby forming a co-planar abrasive surface.

8. The abrasive sheet of claim 7 wherein said perforations comprise from about 10% to about 90% of an area encompassed by said abrasive sheet with from about 10% to about 90% of the remaining surface having brazed grit attached thereto.

9. The abrasive sheet of claim 7 wherein from about 15% to about 20% of an area encompassed by the abrasive sheet includes brazed grit attached thereto with the remainder being encompassed by perforations.

* * * * *